US009982461B1

(12) United States Patent
Kilbourne

(10) Patent No.: US 9,982,461 B1
(45) Date of Patent: May 29, 2018

(54) DEADBOLT AND PASSAGE LOCK ADAPTER

(71) Applicant: Mark W. Kilbourne, Richmond, TX (US)

(72) Inventor: Mark W. Kilbourne, Richmond, TX (US)

( * ) Notice: Subject to any disclaimer, the term of this patent is extended or adjusted under 35 U.S.C. 154(b) by 64 days.

(21) Appl. No.: 15/150,185

(22) Filed: May 9, 2016

Related U.S. Application Data

(60) Provisional application No. 62/158,218, filed on May 7, 2015.

(51) Int. Cl.

| | |
|---|---|
| ***E05B 59/00*** | (2006.01) |
| ***E05B 63/14*** | (2006.01) |
| ***E05B 47/00*** | (2006.01) |
| ***E05B 9/00*** | (2006.01) |
| ***E05C 1/12*** | (2006.01) |
| ***E05B 53/00*** | (2006.01) |
| ***E05B 65/06*** | (2006.01) |
| ***E05F 1/10*** | (2006.01) |

(52) U.S. Cl.

CPC ..... *E05B 47/0012* (2013.01); *E05B 9/002* (2013.01); *E05B 53/003* (2013.01); *E05B 53/008* (2013.01); *E05B 59/00* (2013.01); *E05B 65/06* (2013.01); *E05C 1/12* (2013.01); *E05F 1/1016* (2013.01); *E05B 2047/002* (2013.01); *E05B 2047/0022* (2013.01); *E05B 2047/0048* (2013.01); *E05B 2047/0058* (2013.01); *E05B 2047/0084* (2013.01); *E05B 2047/0091* (2013.01); *E05B 2047/0094* (2013.01); *E05Y 2900/132* (2013.01)

(58) Field of Classification Search

CPC . E05B 47/00; E05B 65/06; E05B 9/00; E05B 59/00; E05B 53/008; E05B 53/003; E05B 9/002; E05B 2047/002; E05B 2047/0022; E05B 2047/0058; E05B 2047/0048; E05B 2047/0084; E05B 2047/0091; E05B 2047/0094; E05F 1/1016; E05C 1/12; E05Y 2900/12

USPC ..... 70/107–111, 190, 191, 257, 277, 278.7, 70/279.1, 280–283, 283.1; 292/38, 39, 292/50, 51, 141, 142, 144, 171, 172, 225, 292/235

See application file for complete search history.

(56) References Cited

U.S. PATENT DOCUMENTS 2,541,723 A * 2/1951 Shaw ..... E05B 15/04 292/171
2,651,934 A * 9/1953 Chesler ..... E05B 55/00 292/359
2,879,725 A * 3/1959 Zuver ..... E05B 65/0075 109/39

(Continued)

*Primary Examiner* — Lloyd A Gall

(57) ABSTRACT

A system that includes a lock adapter assembly configured to be installed on a door. The lock adapter includes a motor assembly comprising a motor configured to provide a rotational force, one or more cords configured to convert the rotation force from the motor into a linear force, a deadbolt lock actuator configured to match to an existing torque blade of a deadbolt lock mounted in the door, a passage lock actuator configured to match to an existing torque blade of a passage lock mounted in the door, and one or more latch spool configured to transfer the linear force from the one or more cords to the deadbolt lock actuator, the passage lock actuator, or combination thereof.

18 Claims, 5 Drawing Sheets

(56) References Cited

U.S. PATENT DOCUMENTS 3,584,905 A * 6/1971 Emenaker ..... E05C 9/063 292/2
3,791,180 A * 2/1974 Doyle ..... E05B 59/00 292/34
3,875,772 A * 4/1975 Ebersman ..... E05B 53/003 292/38
3,924,427 A * 12/1975 San Juaquin ..... E05B 77/48 292/144
4,109,494 A * 8/1978 Allemann ..... E05B 53/003 292/38
4,363,226 A * 12/1982 Remington ..... E05B 37/02 292/28
4,418,552 A * 12/1983 Nolin ..... E05B 59/00 292/21
4,470,276 A * 9/1984 Bayless ..... E05C 7/02 292/37
4,961,601 A * 10/1990 Lindholm ..... E05B 83/16 292/216
4,999,949 A * 3/1991 Granlund ..... E05B 53/003 292/38
5,077,992 A * 1/1992 Su ..... E05B 59/00 292/36
5,394,718 A * 3/1995 Hotzl ..... E05B 47/0012 292/144
5,513,505 A * 5/1996 Dancs ..... E05B 47/026 292/169.13
5,590,917 A * 1/1997 Brooks ..... E05B 15/004 292/21
5,657,653 A * 8/1997 Hensley ..... E05B 55/005 292/DIG. 62
5,713,612 A * 2/1998 Kajuch ..... E05B 53/00 292/21
5,790,034 A 8/1998 Khoury
5,852,944 A * 12/1998 Collard, Jr. ..... E05B 47/0002 292/144
6,035,676 A 3/2000 Hudspeth
6,145,356 A * 11/2000 Thwing ..... E05B 9/084 70/371
6,517,127 B1 2/2003 Lu et al.
6,701,760 B1 * 3/2004 Elliason ..... E05B 19/00 70/252
6,739,164 B2 5/2004 Warmack
6,758,075 B1 * 7/2004 Thwing ..... E05B 11/00 70/372
6,805,386 B2 * 10/2004 Ehret ..... E05B 81/20 292/141
6,813,916 B2 * 11/2004 Chang ..... E05B 47/0012 292/144
6,918,276 B2 * 7/2005 Van Parys ..... E05B 47/0012 70/224
7,788,954 B2 * 9/2010 Schumm ..... E05B 53/005 292/41
7,823,933 B2 * 11/2010 Layos ..... E05B 53/00 292/336.3
2016/0032631 A1 * 2/2016 Patterson ..... E05C 9/048 292/38

* cited by examiner

DEADBOLT AND PASSAGE LOCK ADAPTER

CROSS REFERNCE TO RELATED APPLICATIONS

This application is a non-provisional application that claims priority to U.S. Provisional Application No. 62/158,218, entitled "Retrofit for Passage and Deadbolt Locks using cord," filed May 7, 2015, which is incorporated herein in its entirety by reference.

FIELD

The present invention relates, generally, to systems and methods usable for unlocking a deadbolt and opening a passage lock located on a door. Particularly, the door may be located in an external entry to a home, apartment, hotel, store, or other dwelling or commercial business. In addition, the systems and methods may be used with existing hardware without replacing the deadbolt, passage lock, or the accompanying decorative faceplates.

BACKGROUND

Conventional exterior doors may include one or more manual, keyed deadbolt locks. These locks often function through extension and retraction of a bolt, which slides or extends out from the lock to a deadbolt receptacle in a doorframe surrounding the door. The bolt prevents an unwanted person from opening the door. When the proper key is inserted into the lock from an external side of the door, internal components of the lock allow a rotation that retracts the bolt. While deadbolt locks are generally regarded as an effective security measure, both due to their durability and due to the fact that a unique key is required to operate the lock, manual locks also suffer from a variety of difficulties and inconveniences. For example, modern keys are small in size, and can be readily lost or stolen, requiring any associated locks to be rekeyed to ensure security. Manual operation of a keyed lock can also be cumbersome, such as when attempting to carry objects into a residence, or when rapid entry is necessary, such as during inclement weather or when confronted by a potentially dangerous individual or animal.

Moreover, exterior doors also employ passage locks that hold the door closed when the deadbolt is unlocked or disengaged. Passage locks may include a spring-loaded latchbolt that engages a receptacle in the doorframe in a manner similar to a deadbolt lock. The latchbolt of many passage locks, however, may be opened by rotating a handle or knob without the use of a key. In many instances, the passage lock presents an inconvenience even when the deadbolt is unlocked. For example, opening a passage lock when a person is carrying groceries or other large items may require them to put those things down, or precariously balance them while rotating the handle of the passage lock A need exists for a remotely actuatable locking system that overcomes the deficiencies of conventional entry systems by enabling a person to unlock a deadbolt and unlatch a passage lock remotely.

Furthermore, when adding a remotely actuatable locking system to a home owners door, the home owner prefers consistency in maintaining the selected look of the door and the existing hardware. The external keyhole, lock cover, door knob, and/or handle, and interior thumbturn, trim, and handle, may be a set that has been carefully selected by the homeowner. Therefore, a further need exists for components installable within the body of a door to accomplish entry without covering tor disposing of the existing set already existing on the home owners door.

The present invention meets these needs.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

The present invention relates, generally, to a system usable to provide an adapter to existing lock hardware for entry doors. The adapter provides a person entering through the door to open the door remotely so that the door may open with a slight push. The system uses one or more cords, wires, strings, twine or fishing lines, to turn gears that open the locking mechanisms for a deadbolt lock and a passage lock that are installed together on the door.

Figure 1:
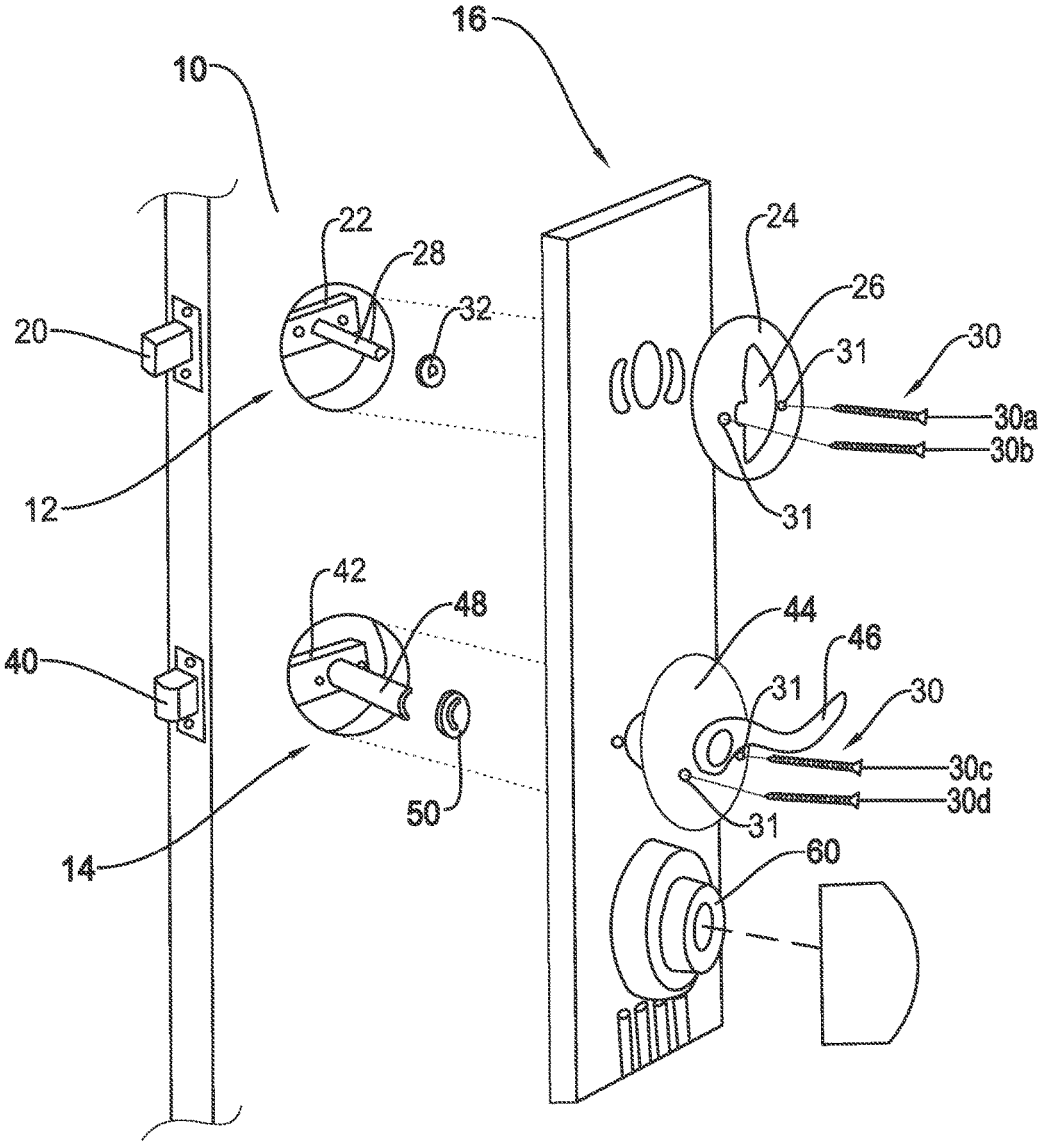
FIG. 1 depicts a perspective view of a door with a deadbolt lock and a passage lock being installed with an embodiment of an adapter assembly.

FIG. 1 depicts a perspective view of a door 10 with a deadbolt lock 12 and a passage lock 14 being installed with an embodiment of an adapter assembly 16. The adapter assembly 16, as described in detail below, unlocks the deadbolt lock 12 and unlatches the passage lock 14 with a remote trigger. The adapter assembly 16 is installed beneath or additionally to the existing hardware that is present on the door 10. The existing hardware means all the hardware described below and any component used to unlock or open the locks on the door prior to installing the adapter assembly 16. As part of the existing hardware, the deadbolt lock 12 may include a barrel 20 that protrudes from the door 10 and into a corresponding slot in a door frame to secure the door 10 closed. To retract the barrel 20 from the door frame, a latch 22 may be rotated, which shortens the latch 22 pulling in the barrel 20. The deadbolt lock 12 may include a faceplate trim 24 and a thumbturn 26 that enables a person on the interior side of the door 10 to rotate the latch 22. An exterior side of the door 10 may have a keyhole into which a key may be inserted to turn the latch 22. The latch 22 is connected to the thumbturn 26 or the key by a torque blade 28 that may have a distinct shape depending on the model or brand of the lock.

The visible components of the existing hardware (namely the faceplate trim 24 and the thumbturn 26) may be attached to the door 10 by screws 30. Specifically, the deadbolt lock 12 may include a first screw 30*a* and a second screw 30*b* that may pass through the faceplate trim 24 and through the latch 22 to connect to the external face on the other side of the door 10. The adapter assembly 16 may include holes 31 so that the screws 30 may pass through the adapter assembly 16 when it is installed. To ensure that the adapter assembly 16 can fit with any model or brand of deadbolt lock 12, the adapter assembly 16 may include an interchangeable actuator 32 that is shaped to adapt the torque blade 28 to the gears of the adapter assembly 16 as explained in detail below.

As further part of the existing hardware, the passage lock 14 may include a passage barrel 40 that protrudes from the door 10 and into a corresponding slot in a door frame to secure the door 10 closed. The passage barrel 40 may be angled on one face to allow the door 10 to be shut without engaging the passage lock 14. This is different than the deadbolt lock 12, the barrel 20 of which stays protruded or retracted until the latch 22 is rotated. To retract the passage barrel 40 from the door frame, a passage latch 42 may be rotated, which shortens the latch 42 pulling in the barrel 40. The passage lock 14 may include an exterior faceplate and handle and an interior faceplate trim 44 and handle 46. Rotating either the exterior handle or interior handle 46 enables a person to rotate the latch 42. The passage latch 42 also may include a torque blade 48 that may include a distinct shape that depends on the model or brand of the lock. A second interchangeable actuator 50 may be matched to the torque blade 48 of the passage lock 14.

Figure 2:
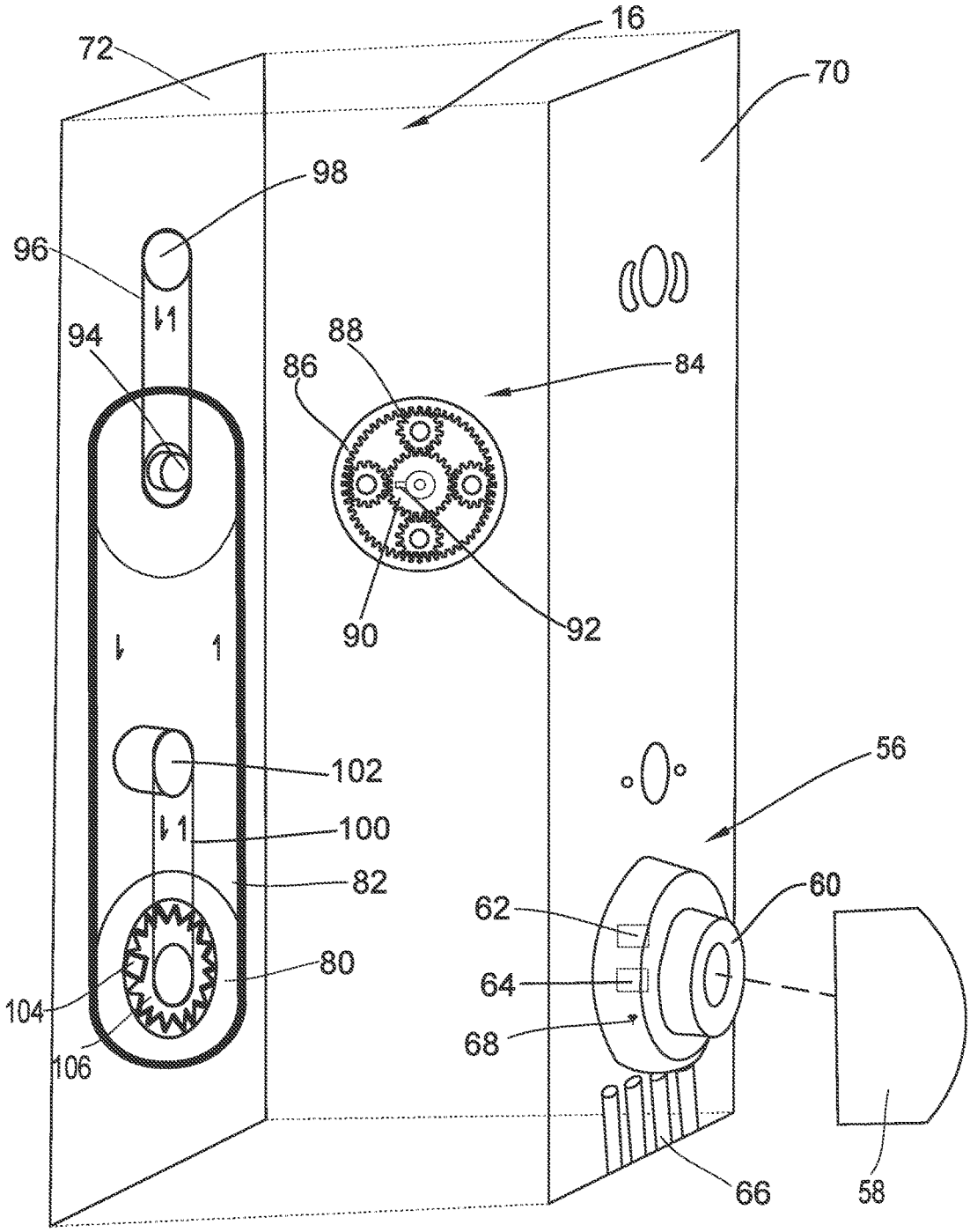
FIG. 2 illustrates an exploded view of an embodiment of the adapter assembly illustrated in FIG. 1.

FIG. 2 illustrates an exploded view of an embodiment of the adapter assembly 16 illustrated in FIG. 1. The adapter assembly 16 includes a motor assembly 56 that may be covered by a covering 58. The motor assembly 56 is configured to receive and power the rotation of the other components of the adapter assembly 16. The motor assembly 56 includes a motor 60 that is electrically connected to a processor 62 and memory 64 containing instructions for the motor 60 to rotate based on a received signal. The instructions may include settings for speed, torque, number of degrees to rotate, or other instructions based on the received signal. The motor assembly 56 is powered by batteries 66. The signal to begin rotation of the motor 60 may be received by a receiver 68 installed within the motor assembly 56. The receiver 68 may receive either wired signals transmitted from a button on the interior or exterior of the door 10. In certain embodiments, the receiver 68 receives wireless signals from a wireless transmitter carried by a person trying to open the door 10. The illustrated embodiment shows the motor assembly 56 attached to a front faceplate 70. The motor assembly 56 may protrude from the front faceplate 70 (as shown), or in some embodiments, may be morticed within a hole in the door 10, maintaining a flat, uniform surface to the front faceplate 70.

Between the front faceplate 70 and a back faceplate 72, the adapter assembly 16 may include a series of gears and cord to convey the rotation of the motor 60 to the locks 12, 14. The motor 60 first rotates a large spool gear 80. The large spool gear 80 rotates a first cord 82 to convey the motion to a planetary gear 84. For purposes of this application and the accompanying claims, the term "cord" is meant to include any and all cordage, string, rope, chain, wire, twine, fishing line, thread, yarn, or other thin article capable of conveying a rotational or linear force. The first cord 82 conveys the rotational force from the large spool gear 80 to the planetary gear 84 that includes a ring gear 86, planet gears 88, and a sun gear 90. The rotation of the ring gear 86 rotates the planet gears 88, which may be fixed to the front faceplate 70, back faceplate 72, or combination thereof. The rotational force is then conveyed to the sun gear 90, which may rotate at a different speed and/or torque in order to rotate the deadbolt lock 12. The planetary gear 84 includes a lug 92 that pushes a transition assembly 94 as explained in detail with regard to FIG. 4.

As the transition assembly 94 rotates, a second cord 96 transforms the rotational force to a deadbolt latch spool 98 which rotates the deadbolt latch 22 to open the deadbolt barrel 20. In certain embodiments, the planet gears 88 may not be fixed to the faceplates 70, 72. In these embodiments, the planetary gear 84 may act as a force differential to allow the first cord 82 to continue rotating after the deadbolt latch 22 has been fully opened.

The large spool gear 80 also rotates a third cord 100 to rotate a passage lock spool 102. The passage lock spool 102 opens the passage latch 42, allowing the person sending the signal to open the door just by pushing slightly. In certain embodiments, the passage lock spool 102 opens only after the deadbolt lock spool 98 has triggered the opening of the deadbolt lock 12. This may be accomplished, in those certain embodiments, by including a lug 104 that rotates a ratchet gear 106 only after the motor 60 has rotated the large spool gear 80 a certain amount. For example, the large spool gear 80 may rotate 90, 135, 180, 270, or more degrees before the lug 104 begins to rotate the third cord 100. Certain embodiments of the ratchet gear 106 may also include a ratchet and pawl configuration that enables the motor 60 to rotate in clockwise or counterclockwise without engaging the ratchet gear 106 at all. This may be useful for locking the deadbolt lock 12 without opening or interacting with the passage lock 14.

Figure 3:
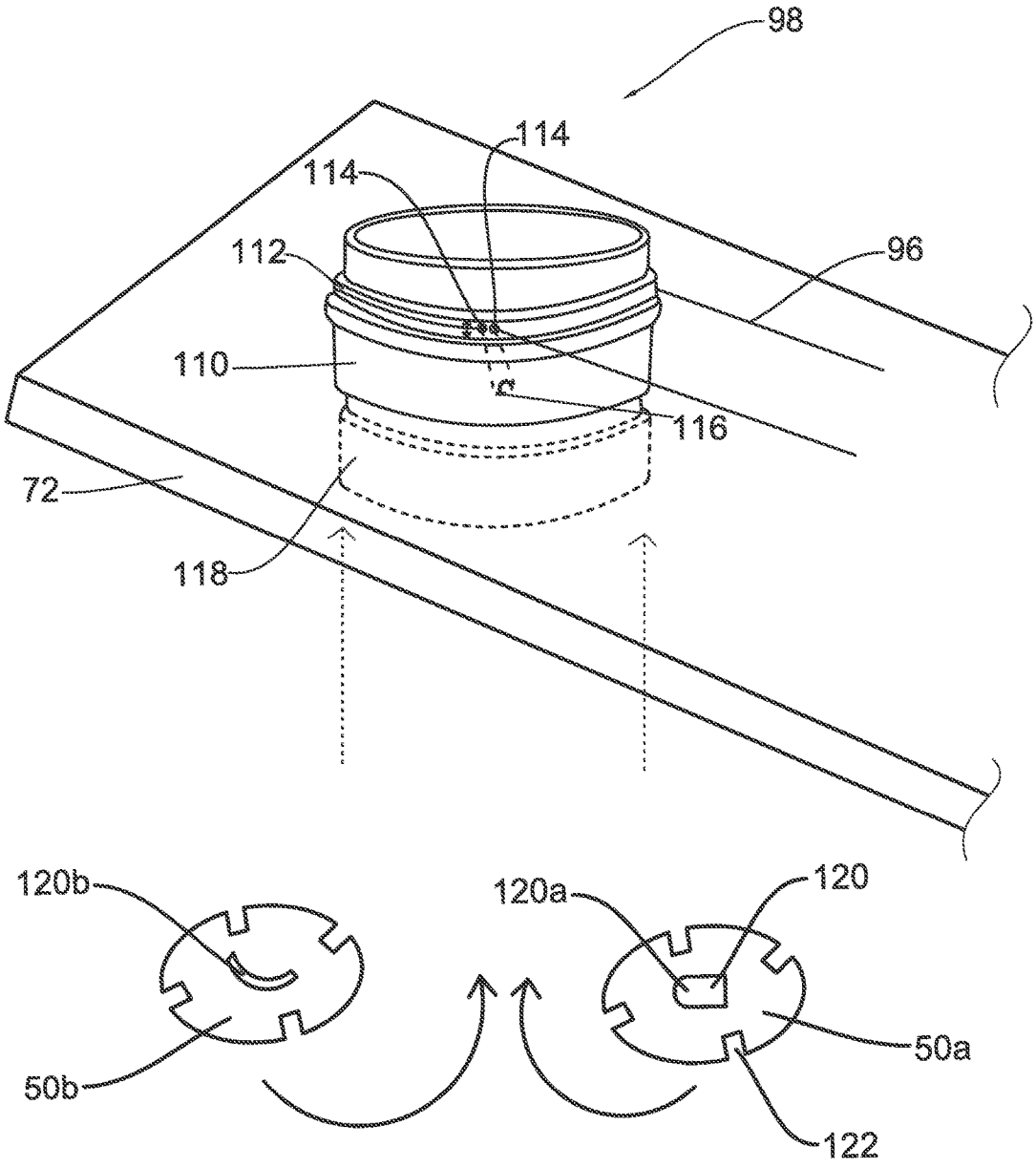
FIG. 3 illustrates an embodiment of the latch spool that may be used to convey a rotation from the adapter assembly to the deadbolt latch or the passage latch.

FIG. 3 illustrates an embodiment of the latch spool 98 that may be used to convey a rotation from the adapter assembly 16 to the deadbolt latch 22 or the passage latch 42. The latch spool 98 is attached to the second cord 96, in the illustrated embodiment, but may be attached to the first cord 82, third cord 100, or other potential cords within the adapter assembly 16. The latch spool 98 may include a cylinder 110 that passes through the back faceplate 72 to convey the rotational force of the cord 96 to the torque blade 28. The second cord 96 may pass around the latch spool 98 while secured within a cord seam 112. The cord seam 112 keeps the second cord 96 from sliding up or down along the cylinder 110, which could change the amount of rotation and/or force needed from the motor 60. To keep the second cord 96 from slipping around the cord seam 112, the latch spool 98 may include a cord hole 114, or two cord holes 114 to lock the second cord 96 (or other cords) in place. For example, the second cord 96 may pass through one of the cord holes 114 and around a cord hook 116. The cord hook 116 holds the second cord 96 in a substantially stationary position such that when the second cord 96 pulls on one side or the other, the whole latch spool 98 will rotate, rather than the second cord 96 rotating by itself.

The latch spool 98, in the illustrated embodiment, includes an actuator receiver 118 that extends from behind the back faceplate 72 into the door 10. The actuator receiver 118 is connected to the cylinder 110 and rotates with the cylinder 110 when pulled by the cord 96. The actuator receiver 118 is configured to match to a plurality of possible actuators 50. For example, the actuator receiver 118 may match to a first interchangeable actuator **50*a* or a second interchangeable actuator 50*b*. The actuators 50 may have torque blade holes 120 that are configured to match the torque blades 28, 48. The actuators 50 may also have notches 122 that fit corresponding protrusions on the inside of the actuator receiver 118. The actuators are installed within the actuator receiver 118 before the adapter assembly 16 is placed onto the door 10. The actuators 50 make it possible for the adapter assembly 16 to fit any and all locks 12, 14 without changing or replacing the components inside the adapter assembly 16. That is, the adapter assembly 16, when matched with the correct actuators 50** may fit any lock without further modification.

Figure 4:
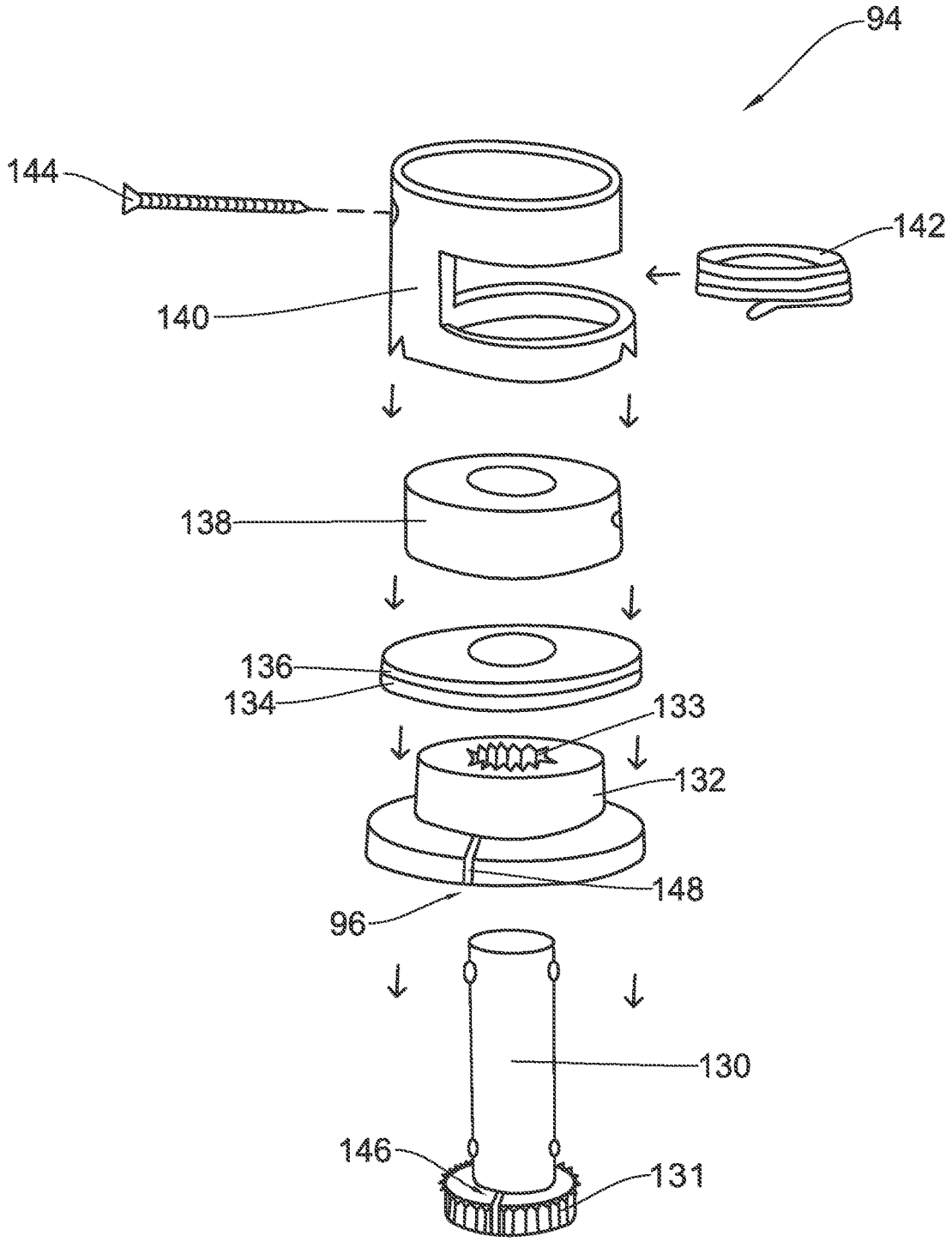
FIG. 4 illustrates an embodiment of the transition assembly that may be used to convey a rotation from the planetary gear to the second cord of the adapter assembly.

FIG. 4 illustrates an embodiment of the transition assembly 94 that may be used to convey a rotation from the planetary gear 84 to the second cord 96 of the adapter assembly 16. The transition assembly 94 includes a stem 130 having external gear teeth 131 that match with a hub 132 having internal gear teeth 133. The stern 130 keeps the various components of the transition assembly 94 together so that the first cord 82 properly transfers the rotational force to the second cord 96. The transition assembly 94 also includes a first disk 134 and a second disk 136 sandwiched together . The first disk 134 has a hole with an interior diameter that allows overlap with the hub 132. The overlap creates a space for the second cord 96 to wrap around. The second disk 136 has a hole with a smaller diameter that fits snugly over the stem 130, but not over the hub 132. This ensures that the first disk 134 does not sandwich too tightly onto the second cord 96. The transition assembly 94 also includes a tube 138 and a housing 140 that create space for a torsion spring 142 to soften the interaction between the transition assembly 94 and the lug 92 of the planetary gear 84. The torsion spring 142 is installed inside the housing 140 and is held in place by a screw 144. As the planetary gear 84 rotates due to the movement of the motor 60, the lug 92 contacts the torsion spring 142. As the lug 92 presses further into the torsion spring 142, the torsion spring 142 transfers the rotation forces into the rest of the transition assembly 94. Without the torsion spring 142, interaction between the lug 92 and the transition assembly 94 would be loud and impactful, decreasing the desirability, functionality, and durability of the adapter assembly 16.

Figure 5:
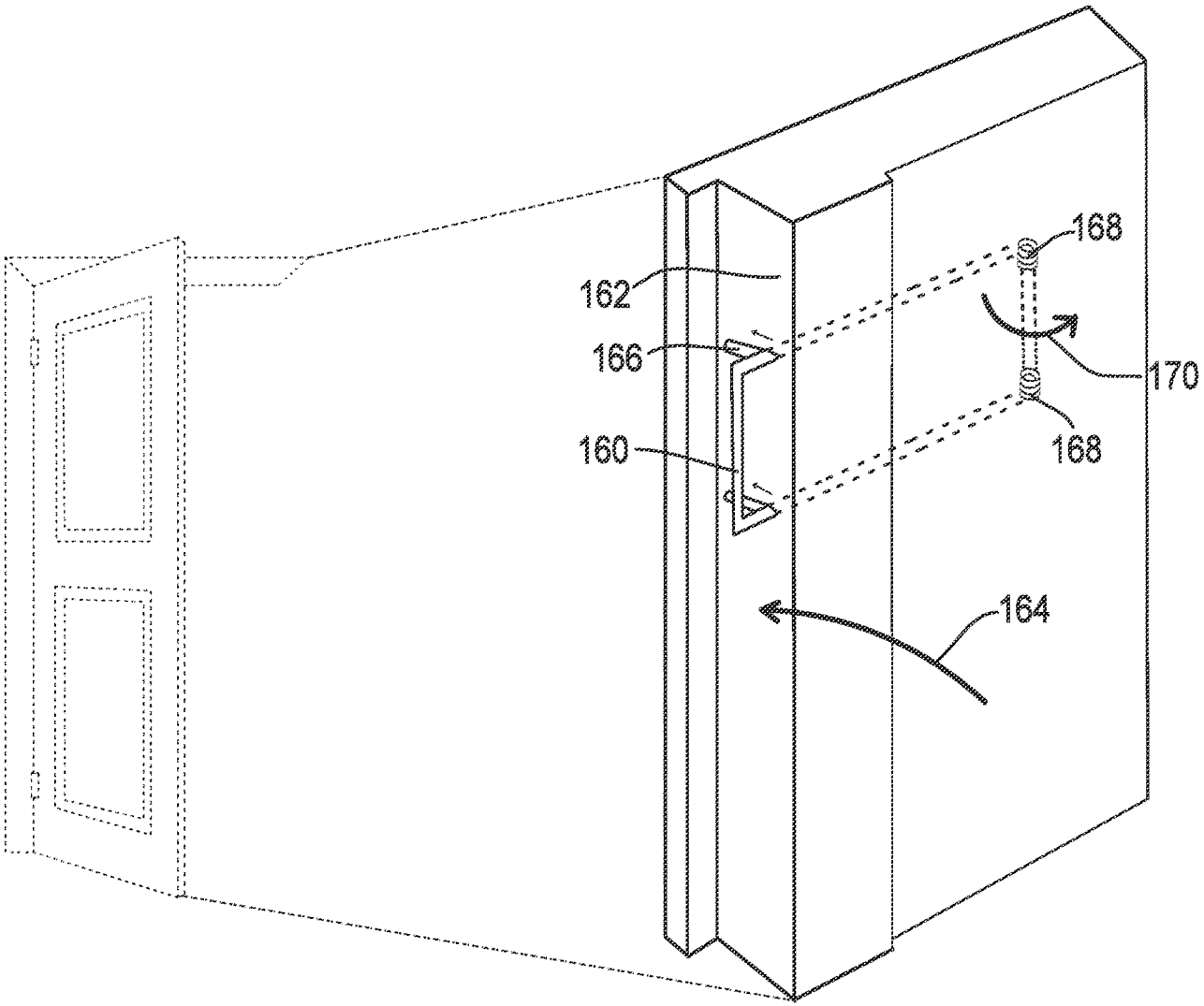
FIG. 5 illustrates an embodiment of a door spring that is configured to provide a door-opening force to the door.

FIG. 5 illustrates an embodiment of a door spring 160 that is configured to provide a door-opening force to the door 10. The door-opening force is useful for the moment when the passage lock 14 is triggered open, so that the door 10 will remain open rather than simply latching again. The door spring 160, in the illustrated embodiment, protrudes from a door frame 162 into which the door 10 will settle when closed. As illustrated, the door 10 settles in a closing direction 164 which depresses the door spring 160 into slots 166. The slots 166 do not have to be very long, for example, the slot 166 may only be 2 mm, 3 mm, 4 mm, 5 mm, or more depending on the strength of the door spring 160. To rebound the motion 164 of the door 10, the door spring 160 may include one or more torsion springs 168 that provide a counterforce 170 in a direction that opposes the closing motion 164 of the door 10.

While the illustrated embodiment illustrates one door spring 160, certain embodiments may include 2, 3, 4, 5, or more door springs 160 to spring open the door 10. For example, the door frame 162 may have a door spring 160 at the top and at the bottom to provide a substantially equal force along the entire height of the door 10. Thus, the adapter assembly 16, in certain embodiments, functions in the following manner to open the door 10 without a person physically touching any of the locking hardware (e.g., deadbolt lock 12, passage lock 14, or adapter assembly 16). To start the method, a person sends a signal (wired, wireless, or other signal) to the motor assembly 56. The signal is received by the receiver 68 and processed (by the processor 62 according to the instructions stored on the memory 64) so that the motor 60 rotates. The motor 60 rotates the first cord 82 which rotates the deadbolt lock 12 until it unlatches. As explained in detail above, the adapter assembly 16 may include a number of gears, lugs, cords, or other components to unlatch the deadbolt lock 12. After the deadbolt lock 12 unlatches, the rotation of the motor 60 causes the passage lock 14 to unlatch. As with the deadbolt lock 12, the adapter assembly 16 may also include a number of gears, lugs, cords, or other components to unlatch the passage lock 14. In certain embodiments, the door 10 may also include a door spring 160 that causes the door 10 to spring open as soon as the passage lock 14 is unlatched.

While various embodiments of the present invention have been described with emphasis, it should be understood that within the scope of the appended claims, the present invention might be practiced other than as specifically described herein.

What is claimed is:

1. A system, comprising:

a lock adapter assembly configured to be installed on a door, comprising a motor assembly comprising a motor configured to provide a rotational force;

a ring gear;

one or more cords configured to transfer the rotational force from the motor to rotate the ring gear;

a deadbolt lock actuator configured to match to an existing torque blade of a deadbolt lock mounted in the door;

a passage lock actuator configured to match to an existing torque blade of a passage lock mounted in the door; and one or more latch spools connected to the one or more cords, wherein the one or more latch spools are configured to rotate the deadbolt lock actuator, the passage lock actuator, or combination thereof when the motor provides the rotational force to the one or more cords.

2. The system of claim 1, wherein the ring gear is configured to rotate a second cord of the one or more cords, and the second cord is configured to rotate the deadbolt lock actuator to unlatch the deadbolt lock.

3. The system of claim 2, wherein the lock adapter assembly comprises a ratchet and pawl that enables the motor to rotate in a first direction without engaging the ratchet and pawl, and enables the motor to rotate in a second direction to engage the ratchet and pawl.

4. The system of claim 1, wherein the lock adapter assembly is configured to be installed between a faceplate trim for the deadbolt lock and the door, and between a faceplate trim for the passage lock and the door.

5. The system of claim 4, wherein the lock adapter assembly is configured to be secured to the door by screws configured to secure the faceplate trim for the deadbolt lock to the door, by screws configured to secure the faceplate trim for the passage lock to the door, or combinations thereof.

6. The system of claim 1, wherein the motor assembly is configured to receive a wireless signal configured to initiate rotation of the motor.

7. The system of claim 1, comprising a door spring configured to be depressed when the door closes, and to force the door open when the passage lock unlatches.

8. The system of claim 7, wherein the door spring comprises a spiral torsion spring configured to be installed within a door frame surrounding the door.

9. The system of claim 1, wherein the deadbolt lock actuator, the passage lock actuator, or combination thereof, is configured to be installed within one or more actuator receivers of a first of the one or more latch spools, wherein the deadbolt lock actuator, or the passage lock actuator comprises notches configured to secure the deadbolt lock actuator, the passage lock actuator, or combination thereof to the actuator receiver.

10. A method of unlatching a deadbolt lock and retracting a passage lock of a door, comprising:

receiving a signal, with a motor assembly, to initiate rotation of a motor;

rotating a large spool gear with the motor to pull a first cord;

rotating a deadbolt latch spool coupled to an existing deadbolt lock, wherein the rotation of the deadbolt latch spool is proportional to the amount of the first cord that is pulled by the large spool gear, and the deadbolt latch spool rotates until the existing deadbolt lock unlatches;

after the deadbolt lock unlatches, rotating a passage latch spool until a passage lock retracts.

11. The method of claim 10, wherein rotating the deadbolt latch spool comprises rotating an interchangeable deadbolt lock actuator configured to match to the existing deadbolt lock.

12. The method of claim 10, wherein rotating the passage latch spool comprises rotating an interchangeable passage lock actuator configured to match to the passage lock.

13. The method of claim 10, comprising forcing the door open after the passage lock retracts.

14. The method of claim 13, wherein forcing the door open comprises pushing the door with a compression insulation surrounding the door.

15. The method of claim 13, wherein forcing the door open comprises pushing the door with a door spring installed with a door frame surrounding the door.

16. The method of claim 10, wherein receiving the signal comprises receiving the signal wirelessly.

17. The method of claim 10, wherein rotating the deadbolt latch spool comprises rotating a planetary gear with the first cord, rotating a second cord with the planetary gear, and rotating the deadbolt latch spool with the second cord.

18. The method of claim 10, wherein rotating the deadbolt latch spool comprises forcing, with a lug, a torsion spring within a transition assembly.

* * * * *